US009133664B2

(12) United States Patent
MacDonald et al.

(10) Patent No.: US 9,133,664 B2
(45) Date of Patent: Sep. 15, 2015

(54) CONTROLLED PRESSURE PULSER FOR COILED TUBING APPLICATIONS

(75) Inventors: Robert MacDonald, Houston, TX (US); Gabor Vecseri, Houston, TX (US); Benjamin Jennings, Houston, TX (US)

(73) Assignee: Teledrill, Inc., Allentown, PA (US)

( * ) Notice: Subject to any disclaimer, the term of this patent is extended or adjusted under 35 U.S.C. 154(b) by 865 days.

(21) Appl. No.: 13/336,981

(22) Filed: Dec. 23, 2011

(65) Prior Publication Data

US 2013/0048300 A1 Feb. 28, 2013

Related U.S. Application Data

(60) Provisional application No. 61/529,329, filed on Aug. 31, 2011.

(51) Int. Cl.

| | |
|---|---|
| ***E21B 1/00*** | (2006.01) |
| ***E21B 4/06*** | (2006.01) |
| ***E21B 4/02*** | (2006.01) |
| ***E21B 47/18*** | (2012.01) |
| ***E21B 17/20*** | (2006.01) |

(52) U.S. Cl.
CPC . *E21B 4/02* (2013.01); *E21B 17/20* (2013.01); *E21B 47/18* (2013.01)

(58) Field of Classification Search
CPC ..... E21B 1/00; E21B 4/06
USPC ..... 166/249, 177.6; 367/83, 84; 340/854.3; 175/324, 317, 38, 56, 40
See application file for complete search history.

(56) References Cited

U.S. PATENT DOCUMENTS

| | | | | |
|---|---|---|---|---|
| 2,397,070 | A | 3/1946 | Zublin | |
| 2,797,893 | A | 7/1957 | McCune et al. | |
| 2,858,107 | A | 10/1958 | Colmerauer | |
| 4,436,165 | A | 3/1984 | Emery | |
| 4,807,704 | A | 2/1989 | Hsu et al. | |
| 6,237,701 | B1 | 5/2001 | Kolle et al. | |
| 7,139,219 | B2 | 11/2006 | Kolle et al. | |
| 7,836,948 | B2 * | 11/2010 | Kusko et al. | 166/249 |
| 7,958,952 | B2 | 6/2011 | Kusko et al. | |
| 8,138,943 | B2 * | 3/2012 | Kusko et al. | 340/855.4 |

* cited by examiner

*Primary Examiner* — Catherine Loikith
(74) *Attorney, Agent, or Firm* — Guerry L. Grune; ePatentManager.com

(57) ABSTRACT

An apparatus, method, and system for generating pressure pulses in a drilling fluid flowing within coiled tubing assembly is described that includes; a flow throttling device longitudinally and axially positioned within the center of a main valve actuator assembly that allows main exit flow fluid to flow past a drive shaft and motor such that the pilot fluid and the main exit flow fluid causes one or more flow throttling devices to generate large, rapid controllable pulses. The pulses generated by the flow throttling device thereby allow transmission of well-developed signals easily distinguished from any noise resulting from other vibrations due to nearby equipment within the borehole or exterior to the borehole, or within the coiled tubing assembly wherein the signals also provide predetermined height, width and shape of the signals.

27 Claims, 2 Drawing Sheets

CONTROLLED PRESSURE PULSER FOR COILED TUBING APPLICATIONS

PRIORITY DOCUMENTS

This application takes priority from U.S. Granted Pat. No. 7,958,952 entitled "Pulse Rate of Penetration Enhancement Device and Method" and filed on Dec. 17, 2008 and U.S. Provisional Application No. 61/529,329 entitled "Full Flow Pulser for Measurement While Drilling (MWD) Device and filed on Aug. 31, 2011. In addition the entire contents of both applications, as filed are hereby incorporated by reference.

FIELD OF DISCLOSURE

The current invention includes an apparatus and a method for controlling a pulse created within drilling fluid or drilling mud traveling along the internal portion of a coiled tubing (CT) housing by the use of a flow throttling device (FTD). The pulse is normally generated by selectively initiating flow driven bidirectional pulses due to proper geometric mechanical designs within a pulser. Coiled Tubing (CT) is defined as any continuously-milled tubular product manufactured in lengths that requires spooling onto a take-up reel, during the primary milling or manufacturing process. The tube is nominally straightened prior to being inserted into the wellbore and is recoiled for spooling back onto the reel. Tubing diameter normally ranges from 0.75 inches to 4 inches and single reel tubing lengths in excess of 30,000 ft. have been commercially manufactured. Common CT steels have yield strengths ranging from 55,000 PSI to 120,000 PSI and the limit is usually reached at no more than 5 inch diameters due to weight limitations. The coiled tubing unit is comprised of the complete set of equipment necessary to perform standard continuous-length tubing operations in the oil or gas exploration field. The unit consists of four basic elements:

1. Reel—for storage and transport of the CT
2. Injector Head—to provide the surface drive force to run and retrieve the CT
3. Control Cabin—from which the equipment operator monitors and controls the CT
4. Power Pack—to generate hydraulic and pneumatic power required to operate the CT unit.

Features of the combined pulsing and CT device include operating a full flow throttling device [FTD] that provides pulses providing more open area to the flow of the drilling fluid in a CT device that also allows for intelligent control above or below a positive displacement motor with downlink capabilities as well as providing and maintaining weight on bit with a feedback loop such that pressure differentials within the collar and associated annular of the FTD inside the bore pipe to provide information for reproducible properly guided pressure pulses with low noise signals. The pulse received "up hole" from the tool down hole includes a series of pressure variations that represent pressure signals which may be interpreted as inclination, azimuth, gamma ray counts per second, etc. by oilfield engineers and managers and utilized to further increase yield in oilfield operations.

BACKGROUND

This invention relates generally to the completion of wellbores. More particularly, this invention relates to new and improved methods and devices for completion, extension, fracing and increasing rate of penetration (ROP) in drilling of a branch wellbore extending laterally from a primary well which may be vertical, substantially vertical, inclined or horizontal. This invention finds particular utility in the completion of multilateral wells, that is, downhole well environments where a plurality of discrete, spaced lateral wells extend from a common vertical wellbore.

Horizontal well drilling and production have been increasingly important to the oil industry in recent years due to findings of new or untapped reservoirs that require special equipment for such production. While horizontal wells have been known for many years, only relatively recently have such wells been determined to be a cost effective alternative (or at least companion) to conventional vertical well drilling. Although drilling a horizontal well costs substantially more than its vertical counterpart, a horizontal well frequently improves production by a factor of five, ten, or even twenty of those that are naturally fractured reservoirs. Generally, projected productivity from a horizontal well must triple that of a vertical hole for horizontal drilling to be economical. This increased production minimizes the number of platforms, cutting investment and operational costs. Horizontal drilling makes reservoirs in urban areas, permafrost zones and deep offshore waters more accessible. Other applications for horizontal wells include periphery wells, thin reservoirs that would require too many vertical wells, and reservoirs with coning problems in which a horizontal well could be optimally distanced from the fluid contact.

Horizontal wells are typically classified into four categories depending on the turning radius:

1. An ultra short turning radius is 1-2 feet; build angle is 45-60 degrees per foot.
2. A short turning radius is 20-100 feet; build angle is 2-5 degrees per foot.
3. A medium turning radius is 300-1,000 feet; build angle is 6-20 degrees per 100 feet.
4. A long turning radius is 1,000-3,000 feet; build angle is 2-6 degrees per 100 feet.

These additional lateral wells are sometimes referred to as drainholes and vertical wells containing more than one lateral well are referred to as multilateral wells. Multilateral wells are becoming increasingly important, both from the standpoint of new drilling operations and from the increasingly important standpoint of reworking existing wellbores including remedial and stimulation work.

As a result, the foregoing increased dependence on and importance of horizontal wells, horizontal well completion, and particularly multilateral well completion, important concerns provide a host of difficult problems to overcome. Lateral completion, particularly at the juncture between the vertical and lateral wellbore is extremely important in order to avoid collapse of the well in unconsolidated or weakly consolidated formations. Thus, open hole completions are limited to competent rock formations; and even then open hole completions are inadequate since there is no control or ability to re-access (or re-enter the lateral) or to isolate production zones within the well. Coupled with this need to complete lateral wells is the growing desire to maintain the size of the wellbore in the lateral well as close as possible to the size of the primary vertical wellbore for ease of drilling and completion.

Conventionally, horizontal wells have been completed using either slotted liner completion, external casing packers (ECP's) or cementing techniques. The primary purpose of inserting a slotted liner in a horizontal well is to guard against hole collapse. Additionally, a liner provides a convenient path to insert coiled tubing in a horizontal well. Three types of liners have been used namely (1) perforated liners, where holes are drilled in the liner, (2) slotted liners, where slots of various width and depth are milled along the line length, and (3) pre-packed liners.

Slotted liners provide limited sand control through selection of hole sizes and slot width sizes. However, these liners are susceptible to plugging. In unconsolidated formations, wire wrapped slotted liners have been used to control sand production. Gravel packing may also be used for sand control in a horizontal well. The main disadvantage of a slotted liner is that effective well stimulation can be difficult because of the open annular space between the liner and the well. Similarly, selective production (e.g., zone isolation) is difficult.

Another option is a liner with partial isolations. External casing packers (ECPs) have been installed outside the slotted liner to divide a long horizontal well bore into several small sections. This method provides limited zone isolation, which can be used for stimulation or production control along the well length. However, ECP's are also associated with certain drawbacks and deficiencies. For example, normal horizontal wells are not truly horizontal over their entire length; rather they have many bends and curves. In a hole with several bends it may be difficult to insert a liner with several external casing packers. Finally, it is possible to cement and perforate medium and long radius wells as shown, for example, in U.S. Pat. No. 4,436,165.

While sealing the juncture between a vertical and lateral well is of importance in both horizontal and multilateral wells, re-entry and zone isolation is of particular importance and pose particularly difficult problems in multilateral wells completions. Re-entering lateral wells is necessary to perform completion work, additional drilling and/or remedial and stimulation work. Isolating a lateral well from other lateral branches is necessary to prevent migration of fluids and to comply with completion practices and regulations regarding the separate production of different production zones. Zonal isolation may also be needed if the borehole drifts in and out of the target reservoir because of insufficient geological knowledge or poor directional control; and because of pressure differentials in vertically displaced strata as will be discussed below.

When horizontal boreholes are drilled in naturally fractured reservoirs, zonal isolation is seen as desirable. Initial pressure in naturally fractured formations may vary from one fracture to the next, as may the hydrocarbon gravity and likelihood of coning. Allowing different fractures to produce together, permits cross flow between fractures and a single fracture with early water breakthrough, which may jeopardize the entire well's production.

As mentioned above, initially horizontal wells were completed with uncemented slotted liner unless the formation was strong enough for an open hole completion. Both methods make it difficult to determine producing zones and, if problems develop, practically impossible to selectively treat the right zone. Today, zone isolation is achieved using either external casing packers on slotted or perforated liners or by conventional cementing and perforating.

The problem of lateral wellbore (and particularly multilateral wellbore) completion has been recognized for many years as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g., re-entry) a lateral subsequent to completion thereof.

Notwithstanding the above-described attempts at obtaining cost effective and workable lateral well completions, there continues to be a need for new horizontal wells to increase, for example, unconventional shale plays—which are wells exhibiting low permeability and therefore requiring horizontal laterals increasing in length to maximize reservoir contact. With increased lateral length, the number of zones fractured increases proportionally.

Most of these wells are fractured using the "Plug and Perf" method which requires perforating the zone nearest the toe of the horizontal section, fracturing that zone and then placing a composite plug (pumped down an electrical line) followed by perforating the next set of cluster. The process is repeated numerous times until all the required zones are stimulated. Upon completing the fracturing operation, the plugs are removed with a positive displacement motor (PDM) and mill run on coiled tubing. As the lateral length increases, milling with coiled tubing becomes less efficient, leading to the use of jointed pipe for removing plugs.

Two related reasons cause this reduction in efficiency of the CT. First, as the depth increases, the effective maximum weight on bit (WOB) decreases. Second, at increased lateral depths, the coiled tubing is typically in a stable helical spiral in the wellbore. The operator sending the additional coiled tubing (and weight from the surface) will have to overcome greater static loads leading to a longer and inconsistent transmission of load to the bit. This phenomenon is referred to as "stick/slip" in field operations. The onset of these two effects is controlled by several factors including; CT shell thickness, wellbore deviation and build angle, completion size, CT/completion contact friction drag, fluid drag, debris, and bottomhole assembly (BHA) weight and size. CT outer diameter less than 4 inches tends to buckle due to easier helical spiraling, thus increasing the friction from the increased contact surface with the wall of the bore hole. CT outer diameter above 4 inches is impractical due to weight and friction limitations, wellbore deviation is normally not well controlled, friction drag is a function of CT shell thickness and diameter, leaving end loads as one of the variables most studied for manipulation to achieve better well completion.

SUMMARY

The need to effectively overcome these challenges for both lateral reach and improved plug milling has led to the development of the current CT/pulser tool. The tool allows for improved methods that provide better well completions, the ability to re-enter lateral wells (particularly in multilateral systems), achieving extended reach zone isolation between respective lateral wells in a multilateral well system, communicating uphole the downhole formation information, better rate and direction of penetration with proper WOB, as well as providing for controlled pulsing of the pulser in a proper directional manner.

Current pulser technology utilizes pulsers that are sensitive to different fluid pump down hole pressures, and flow rates, and require field adjustments to pulse properly so that meaningful signals from these pulses can be received and interpreted uphold using Coil Tubing (CT) technology. Newer technology incorporated with CT has included the use of water hammer devices producing a force when the drilling fluid is suddenly stopped or interrupted by the sudden closing of a valve. This force created by the sudden closing of the valve can be used to pull the coiled tubing deeper into the wellbore. The pull is created by increasing the axial stress in the coiled tubing and straightening the tubing due to momentary higher fluid pressure inside the tubing and thus reducing the frictional drag. This task—generating the force by opening and closing valves—can be accomplished in many ways—and is also the partial subject of the present disclosure.

The present disclosure and associated embodiments allows for providing a pulser system within coil tubing such that the pulser decreases sensitivity to fluid flow rate or overall fluid pressure within easily achievable limits, does not require field adjustment, and is capable of creating recognizable, repeatable, reproducible, clean [i.e. noise free] fluid pulse signals using minimum power due to a unique flow throttling device [FTD]. The pulser is a full flow throttling device without a centralized pilot port, thus reducing wear, clogging and capital investment of unnecessary equipment as well as increasing longevity and dependability in the down hole portion of the CT. This augmented CT still utilizes battery, magneto-electric and/or turbine generated energy to provide (MWD) measurement while drilling, as well as increased (ROP) rate of penetration capabilities within the CT using the FTD of the present disclosure.

Additional featured benefits of the present inventive device and associated methods include having a pulser tool above and/or below the PDM (positive displacement motor) allowing for intelligence gathering and transmitting of real time data by using the pulser above the motor and as an efficient drilling tool with data being stored in memory below the motor with controlled annular pressure, acceleration, as well as downhole WOB control. The WOB control is controlled by using a set point and threshold for the axial force provided by the shock wave generated using the FTD. Master control is provided uphole with a feedback loop from the surface of the well to the BHA above and/or below the PDM The coiled tubing industry continues to be one of the fastest growing segments of the oilfield services sector, and for good reason. CT growth has been driven by attractive economics, continual advances in technology, and utilization of CT to perform an ever-growing list of field operations. The economic advantages of the present invention include; increased efficiency of milling times of the plugs by intelligent downhole assessments, extended reach of the CT to the end of the run, allowing for reduction of time on the well and more efficient well production (huge cost avoidances), reduced coil fatigue by eliminating or reducing CT cycling (insertion and removal of the CT from the well), high pressure pulses with little or no kinking and less friction as the pulses are fully controlled, and a lower overall power budget due to the use of the intelligent pulser.

DETAILED DESCRIPTION

The present invention will now be described in greater detail and with reference to the accompanying drawings.

Figure 1:
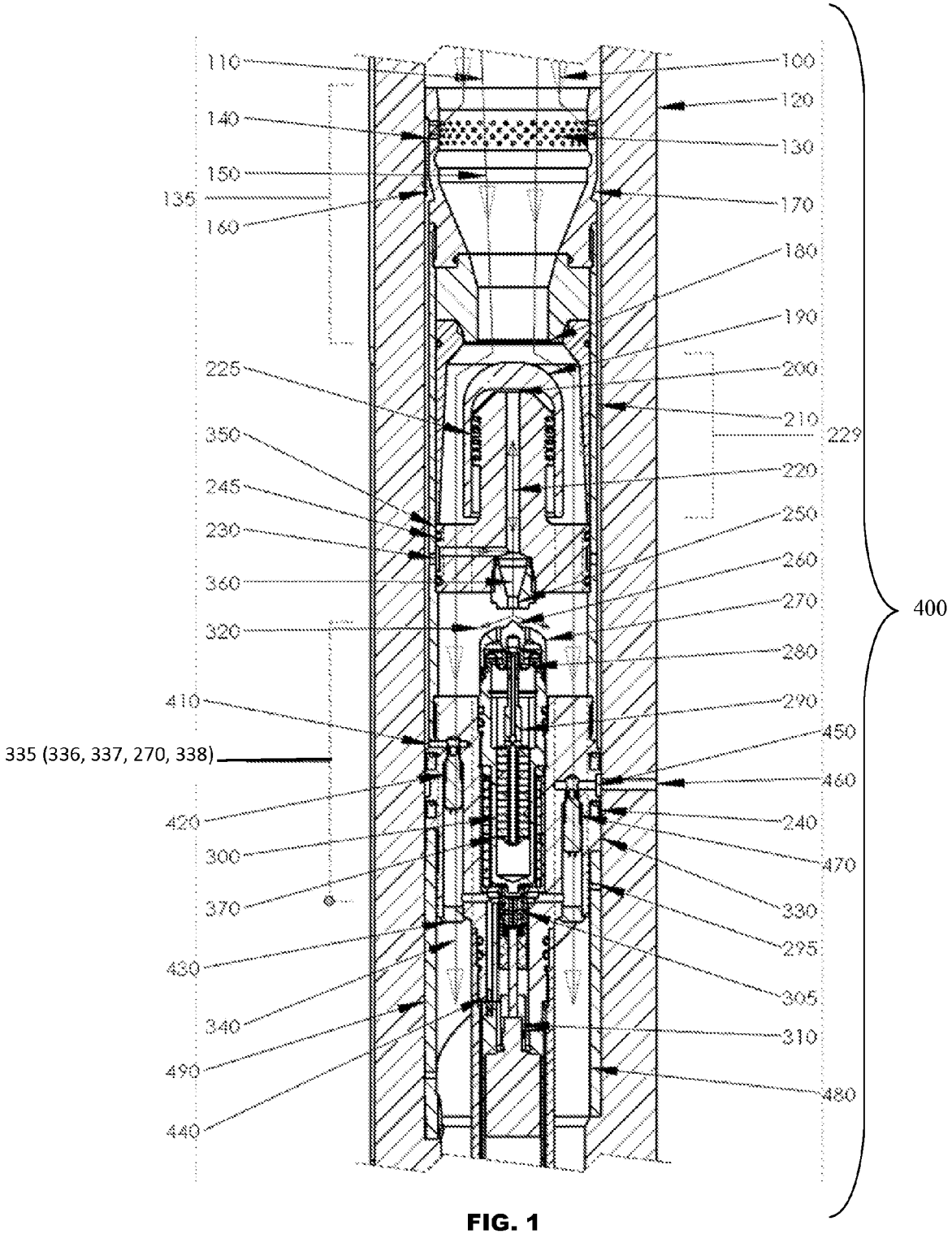
FIG. 1 is an overview of the full flow MWD.

With reference to FIG. 1, the pulser assembly [400] device illustrated produces pressure pulses in drilling fluid main flow [110] flowing through a tubular hang-off collar [120. The flow cone [170] is secured to the inner diameter of the tubular hang-off collar [120] and includes a pilot flow upper annulus [160]. Major assemblies of the MWD are shown as provided including aligned within the bore hole of the hang-off collar [120] are the pilot flow screen assembly [135], the main valve actuator assembly [229], the pilot actuator assembly [335] (comprising a rear pilot shaft [336], front pilot shaft [337], pilot shield [270], and pilot [338]), and the helical pulser support [480].

In FIG. 1, starting from top is the pilot flow screen assembly [135] which houses the pilot flow screen [130] which leads to the pilot flow upper annulus [160], the flow cone [170] and the main orifice [180].

In FIG. 1, starting from an outside position and moving toward the center of the main valve actuator assembly [229] comprising a main valve [190], a main valve pressure chamber [200], a main valve support block [350], main valve seals [225] and pilot flow seals [245]. Internal to the main valve support block [350] is a main valve feed channel [220] and the pilot orifice [250].

The pilot actuator assembly [335] houses the pilot valve [260], pilot shield [270], bellows [280] and the anti-rotation block [290], rotary magnetic coupling [300], the bore pipe pressure sensor [420], the annular pressure sensor [470], as well as a helically cut cylinder [490] which rests on the helical pulser support [480] and tool face alignment key [295] that keeps the pulser assembly rotated in a fixed position in the tubular hang-off collar [120]. This figure also shows the passage of the drilling fluid main flow [110] past the pilot flow screen [130] through the main flow entrance [150], into the flow cone [170], through the main orifice [180] into and around the main valve [190], past the main valve pressure chamber [200], past the main valve seals [225] through the main valve support block [350], after which it combines with the pilot exit flow [320]] both of which flow through the pilot valve support block [330] to become the main exit flow [340].

The pilot flow [100] flows through the pilot flow screen [130] into the pilot flow screen chamber [140], through the pilot flow upper annular [160], through the pilot flow lower annulus [210] and into the pilot flow inlet channel [230], where it then flows up into the main valve feed channel [220] until it reaches the main valve pressure chamber [200] where it flows back down the main valve feed channel [220], through the pilot flow exit channel [360], through the pilot orifice [250], past the pilot valve [260] where the pilot exit flow [320] flows over the pilot flow shield [270] where it combines with the drilling fluid main flow [110] to become the main exit flow [340] as it exits the pilot valve support block [330] and flows past the bore pipe pressure sensor [420] and the annulus pressure sensor [470] imbedded in the pilot valve support block [330] on either side of the rotary magnetic coupling [300], past the drive shaft [305] and the drive motor [310]. The pilot flow lower annulus [210] extends beyond the pilot flow inlet channel [230] in the main valve support block [350], to the pilot valve support block [330] where it connects to the bore pipe pressure inlet [410] where the bore pipe pressure sensor [420] is located. Inside the pilot valve support block [330] also housed an annulus pressure sensor [470] which is connected through an annulus pressure inlet [450] to the collar annulus pressure port [460]. The lower part of the pilot valve support block [330] is a helically cut cylinder [490] that mates with and rests on the helical pulser support [480] which is mounted securely against rotation and axial motion in the tubular hang-off collar [120]. The helical pulser support [480] is designed such that as the helically cut cylinder [490] of the pilot valve support block [330] sits on it, the annulus pressure inlet [450] is aligned with the collar annulus pressure port [460]. The mating area of the pressure ports are sealed off by flow guide seals [240] to insure that the annulus pressure sensor [470] receives only the annulus pressure from the collar annulus pressure port [460]. The electrical wiring of the pressure sensors [420, 470] are sealed off from the fluid of the main exit flow [340] by using sensor cavity plugs [430] and the wires are routed to the electrical connector [440].

The pilot actuator assembly [335] includes a magnetic pressure cup [370], and encompasses the rotary magnetic coupling [300]. The magnetic pressure cup [370] and the rotary magnetic coupling [300] may comprise several magnets, or one or more components of magnetic or ceramic material exhibiting several magnetic poles within a single component. The magnets are located and positioned in such a manner that the rotary movement or the magnetic pressure cup [370] linearly and axially moves the pilot valve [260]. The rotary magnetic coupling [300] is actuated by the drive motor [310] via the drive shaft [305].

Figure 2:
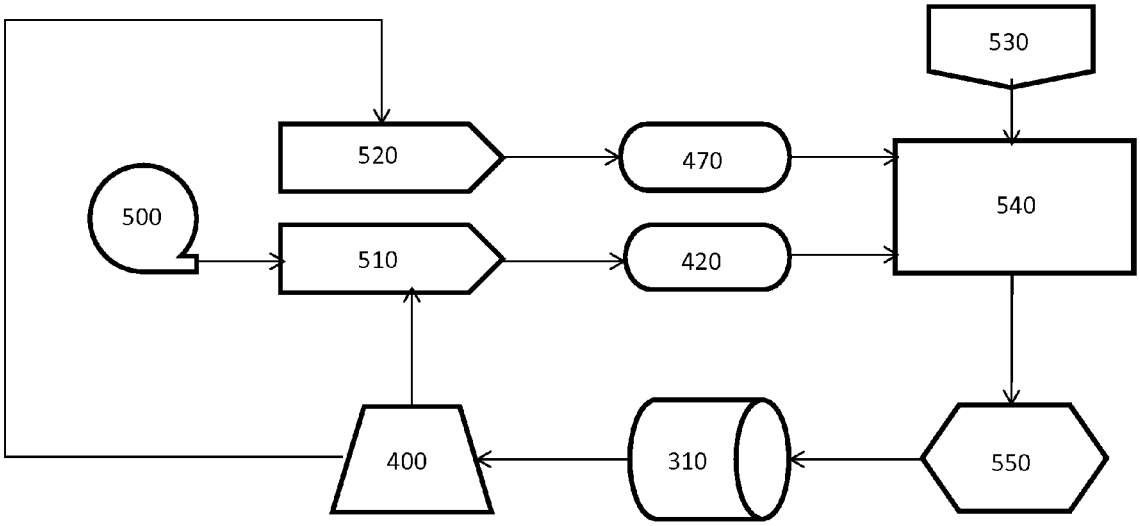
FIG. 2 is a pulsar control flow diagram for coil tubing application

The information flow on the Pulser Control Flow Diagram in FIG. 2 details the smart pulser operation sequence. The drilling fluid pump, known as the mud pump [500] is creating the flow with a certain base line pressure. That fluid pressure is contained in the entirety of the interior of the drill string [510], known as the bore pressure. The bore pipe pressure sensor [420] is sensing this pressure increase when the pumps turn on, and send that information to the Digital Signal Processor (DSP) [540] which interprets it. The DSP [540] also receives information from the annulus pressure sensor [470] which senses the drilling fluid (mud) pressure as it returns to the pump [500] in the annular (outside) of the drill pipe [520]. Based on the pre-programmed logic [530] in the software of the DSP [540], and on the input of the two pressure sensors [420, 470] the DSP [540] determines the correct pulser operation settings and sends that information to the pulser motor controller [550]. The pulser motor controller [550] adjusts the stepper motor [310] current draw, response time, acceleration, duration, revolution, etc. to correspond to the pre-programmed pulser settings [530] from the DSP [540]. The stepper motor [310] driven by the pulser motor controller [550] operates the pilot actuator assembly [335] from FIG. 1. The pilot actuator assembly [335], responding exactly to the pulser motor controller [550], opens and closes the main valve [190], from FIG. 1, in the very sequence as dictated by the DSP [540]. The main valve [190] opening and closing creates pressure variations of the fluid pressure in the drill string [510] on top of the bore pressure which is created by the mud pump [500]. The main valve [190] opening and closing also creates pressure variations of the fluid pressure in the annulus of the drill string on top of the base line annulus pressure created in the annular of the drill pipe [520] because the fluid movement restricted by the main valve [190] affects the fluid pressure downstream of the pulser assembly [400] through the drill it jets into the annulus of the bore hole. Both the annulus pressure sensor [470] and the bore pipe pressure sensor [420] detecting the pressure variation due to the pulsing and the pump base line pressure sends that information to the DSP [540] which determines the necessary action to be taken to adjust the pulser operation based on the pre-programmed logic [530].

Operation—Operational Pilot Flow—all when the Pilot is in the Closed Position;

In FIG. 1 the drive motor [310] rotates the rotary magnetic coupling [300] via a drive shaft [305] which transfers the rotary motion to linear motion of the pilot valve [260] by using an anti-rotation block [290]. The mechanism of the rotary magnetic coupling [300] is immersed in oil and is protected from the drilling fluid flow by a bellows [280] and a pilot flow shield [270]. When the drive motor [310] moves the pilot valve [260] forward [upward in FIG. 1] into the pilot orifice [250], the pilot fluid flow is blocked and backs up in the pilot flow exit channel [360], pilot flow inlet channel [230], the pilot flow lower annulus [210] and in the pilot flow upper annular [160] all the way back to the pilot flow screen [130] which is located in the lower velocity flow area due to the larger flow area of the main flow [110] and pilot flow [100] where the pilot flow fluid pressure is higher than the fluid flow through the restricted area of the main orifice [180]. The pilot fluid flow [100] in the pilot flow exit channel [360] also backs up through the main valve feed channel [220] and into the main valve pressure chamber [200]. The fluid pressure in the main valve pressure chamber [200] is equal to the drilling fluid main flow [110] pressure, and this pressure is higher relative to the pressure of the main fluid flow in the restricted area of the main orifice [180] in the front portion of the main valve [190]. This differential pressure between the pilot flow in the main valve pressure chamber [200] area and the main flow through the main orifice [180] causes the main valve [190] to act like a piston and to move toward closure [still upward in FIG. 1 to stop the flow of the main fluid flow [110] causing the main valve [190] to stop the drilling fluid main flow [110] through the main orifice [180]. As the drilling fluid main flow [110] stops at the main valve [190] its pressure increases. Since the pilot flow lower annulus [210] extends to the bore pipe pressure inlet [410] located in the pilot valve support block [330] the pressure change in the pilot fluid flow reaches the bore pipe pressure sensor [420] which transmits that information through the electrical connector [440] to the DSP [540] as shown in FIG. 2. The DSP [540] together with pressure data from the annulus pressure sensor [470] adjusts the pilot valve operation based on pre-programmed logic [530] to achieve the desired pulse characteristics.

Opening Operation

When the drive motor [310] moves the pilot valve [260] away [downward in FIG. 1] from the pilot orifice [250] allowing the fluid to exit the pilot exit flow [320] and pass from the pilot flow exit channel [360] relieving the higher pressure in the main valve pressure chamber [200] which causes the fluid pressure to be reduced and the fluid flow to escape In. this instance, the drilling fluid main flow [110] having higher pressure than the main valve pressure chamber [200] is forced to flow through the main orifice [180] to push open [downward in FIG. 1] the main valve [190], thus allowing the drilling fluid main flow [110] to bypass the main valve [190] and to flow unencumbered through the remainder of the tool.

Pilot Valve in the Open Position

As the drilling fluid main flow [110] combined with the pilot flow [100] enter the main flow entrance [150] and flow through into the flow cone area [170], by geometry [decreased cross-sectional area], the velocity of the fluid flow increases. When the fluid reaches the main orifice [180] the fluid flow velocity is and the pressure of the fluid is decreased relative to the entrance flows [main flow entrance area vs. the orifice area] [180]. When the pilot valve [260] is in the opened position, the main valve [190] is also in the opened position and allows the fluid to pass through the main orifice [180] and around the main valve [190], through the openings in the main valve support block [350] through the pilot valve support block [330] and subsequently into the main exit flow [340].

What is claimed is:

1. An apparatus for generating pressure pulses in a drilling fluid flowing and enhancing completing a well bore within a coiled tubing assembly comprising:

a flow throttling device longitudinally and axially positioned within the center of a main valve actuator assembly, said main valve actuator assembly comprising a main valve pressure chamber, a magnetic cup encompassing a rotary magnetic coupling containing at least one magnet adjacent to a drive shaft wherein said magnetic cup is located within a pilot actuator assembly, said pilot actuator assembly including a pilot orifice with a pilot valve, a pilot flow shield, a bellows and an anti-rotation block such that passage of said drilling fluid flows through a pilot flow screen and further flows into a main flow entrance into a flow cone through a main orifice and into a main valve past the main valve pressure chamber past a set of seals and through a main valve support block toward a flow seal guide where said fluid combines with a pilot exit fluid that flows toward a main exit flow such that as said fluid becomes a pilot fluid, said pilot fluid subsequently flows through said pilot flow screen into said pilot flow screen chamber through a pilot flow upper annulus, through a pilot flow lower annulus and into a pilot flow inlet channel, wherein said pilot fluid then flows up into a main valve feed channel until it reaches the main valve pressure chamber such that said pilot fluid flows back down a main valve feed channel through a pilot flow exit channel through said pilot orifice and said pilot valve such that said pilot fluid exits said pilot valve and said pilot fluid then flows over said pilot flow shield such that said pilot fluid combines with said main flow to become a main exit flow fluid, said main exit flow fluid then exits a pilot valve support block and flows on either side of said magnetic cup including said rotary magnetic coupling and wherein one or more pressure sensors measuring the pressure of flowing fluid is located inside said pilot valve support block upon which a helical pulser support rests wherein said pilot valve support block also houses an annular pressure sensor residing in an annular pressure inlet and wherein a lower portion of said pilot valve support block also contains a helically cut cylinder that mates with and rests on the helical pulser support that is mounted securely in a tubular hang-off collar such that said annular pressure inlet is aligned with one or more collared annular pressure ports thus still allowing said main exit flow fluid to flow past the drive shaft and motor such that said pilot fluid and main exit flow fluid causes one or more flow throttling devices to generate large, rapid controllable pulses thereby allowing transmission of well-developed signals easily distinguished from any noise resulting from other vibrations due to nearby equipment within said borehole or exterior to said borehole, or within said coiled tubing assembly, wherein said signals also are capable of providing predetermined height, width and shape.

2. The apparatus of claim 1, wherein a mating area for electrical wiring with said annular pressure sensors exist for said collared annular pressure ports such that said ports are sealed off by flow guide seals insuring that said annular pressure sensors receive and sense only the annular pressure within said collared annular pressure ports.

3. The apparatus of claim 1, wherein electrical wiring of said annular pressure sensors are sealed off from the flow of said main exit flow fluid with sensor cavity plugs and wherein said wires are routed to an electrical connector.

4. The apparatus of claim 1, wherein said apparatus for generating pulses includes a pilot, a pilot bellows, a flow throttling device, and a main valve pressure chamber, such that said flow throttling device and said pilot are capable of bi-directional axial movement without a guide pole.

5. The apparatus of claim 1, wherein a magnetic coupling is formed by a location external and internal to said magnetic pressure cup where outer magnets are placed in relation to inner magnets, said inner magnets located in a position inside said magnetic pressure cup, said coupling allowing for translating rotational motion of said motor and outer magnets to linear motion of said inner magnets via a magnetic polar interaction, wherein linear motion of said inner magnets move said pilot actuator assembly, thereby linearly moving a pilot into a pilot seat, closing a pilot seat orifice, lifting a flow throttling device into a flow throttling orifice and thereby generating a pulse wherein further rotation of said motor drive shaft, and outer magnets move said pilot actuator assembly and said pilot away from said pilot seat causing said flow throttling device to move away from said flow throttling orifice, thereby ending a positive pulse.

6. The apparatus of claim 1, wherein said motor is connected to the drive shaft through a mechanical device including mechanical means including a worm gear, or barrel cam face cam for converting the rotational motion of said motor into linear motion to propel said pilot actuator assembly.

7. The apparatus of claim 1, wherein said apparatus includes a path for said pilot and said flow throttling device for operation in a bi-directional axial movement.

8. The apparatus of claim 1, wherein said pilot actuator assembly is comprised of a rear pilot shaft, front pilot shaft, pilot shield, and pilot.

9. The apparatus of claim 1, wherein differential pressure is maximized with the use of said flow cone in that said cone provides for increasing the velocity of said drilling fluid through said main valve actuator assembly, thereby greatly enhancing the pressure differential and controllability of energy pulses created by engagement or disengagement of said pilot valve from a pilot seat.

10. The apparatus of claim 1, wherein energy consumption is further reduced by pre-filling a bellows chamber with a lubricating fluid, gel or paste.

11. The apparatus of claim 1, wherein said apparatus for generating pulses includes allowing a bellows to move linearly, concurrent with said pilot actuator assembly, wherein the design of said bellows interacts with said pilot actuator assembly and a bellows chamber allowing said bellows to conform to the space constraints of said bellows chamber providing flexible sealing without said bellows being displaced by the pressure differential created by said drilling fluid.

12. The apparatus of claim 1, wherein said bellows may include a double loop configuration designed for said flexible sealing thereby requiring less energy consumption during displacement of said bellows.

13. The apparatus of claim 1, wherein said pulse in drilling mud is sensed by instrumentation located uphole and wherein said pulse is communicated with wireless devices, to a computer with a programmable controller for interpretation.

14. A method for generating pressure pulses in a drilling fluid flowing and enhancing completion of a well bore within a coiled tubing assembly comprising:

assembling and utilizing a flow throttling device longitudinally and axially positioned within the center of a main valve actuator assembly such that said main valve actuator assembly comprises a main valve pressure chamber, a magnetic cup encompassing a rotary magnetic coupling containing at least one magnet adjacent to a drive shaft wherein said magnetic cup is located within a pilot actuator assembly and said pilot actuator assembly also includes a pilot orifice with a pilot valve, a pilot flow shield, a bellows and an anti-rotation block for allowing flow of said drilling fluid through a pilot flow screen further allowing flowing into a main flow entrance into a flow cone through a main orifice and into a main valve past the main valve pressure chamber past a set of seals and through a main valve support block toward a flow seal guide where said fluid combines with a pilot exit fluid that flows toward a main exit flow such that as said fluid becomes a pilot fluid, said pilot fluid subsequently flowing through said pilot flow screen into said pilot flow screen chamber through a pilot flow upper annulus, through a pilot flow lower annulus and into a pilot flow inlet channel, wherein said pilot fluid next is flowing up into a main valve feed channel until it reaches the main valve pressure chamber such that said pilot fluid is subsequently flowing back down the main valve feed channel through a pilot flow exit channel through said pilot orifice and said pilot valve such that said pilot fluid exits said pilot valve and said pilot fluid is subsequently flowing over said pilot flow shield to allow for combining pilot fluid with said main flow to become the main exit flowing fluid, said main exit flowing fluid next exits a pilot valve support block and continues flowing on either side of said magnetic cup including said rotary magnetic coupling and wherein one or more pressure sensors measuring the pressure of flowing fluid are located inside said pilot valve support block upon which a helical pulser support is resting and wherein said pilot valve support block is also housing an annular pressure sensor residing in an annular pressure inlet and wherein a lower portion of said pilot valve support block is also containing a helically cut cylinder for mating with and resting on the helical pulser support mounted securely in a tubular hang-off collar such that said annular pressure inlet is aligning with one or more collared annular pressure ports thus still allowing said main exit flowing fluid to flow past the drive shaft and motor such that said pilot fluid and main exit flowing fluid is causing one or more flow throttling devices to generate large, rapid controllable pulses thereby allowing transmission of well-developed signals easily distinguished from any noise resulting from other vibrations due to nearby equipment within said borehole or exterior to said borehole, or within said coiled tubing assembly, and wherein said signals also are capable of providing predetermined height, width and shape.

15. The method of claim 14, such that a mating area existing for electrical wiring with said annular pressure sensors is being utilized for said collared annular pressure ports such that said ports are sealed off by flow guide seals insuring that said annular pressure sensors are receiving and sensing only the annular pressure within said collared annular pressure ports.

16. The method of claim 14, such that sealing of electrical wiring for said annular pressure sensors ensures that said sensors are sealed off from the flowing of said main exit flowing fluid with sensor cavity plugs and wherein routing said wires to an electrical connector is also achieved.

17. The method of claim 14, wherein said method for generating pulses includes using a pilot, a pilot bellows, a flow throttling device, and a main valve pressure chamber, such that said flow throttling device and said pilot perform bi-directional axial movement without a guide pole.

18. The method of claim 14, wherein forming a magnetic coupling by a location external and internal to said magnetic pressure cup exists such that outer magnets are placed in relation to inner magnets, said inner magnets being located in a position inside said magnetic pressure cup, said coupling allowing for translating rotational motion of said motor and outer magnets to linear motion of said inner magnets via a magnetic polar interaction, wherein linear motion of said inner magnets move said pilot actuator assembly, thereby linearly moving a pilot into a pilot seat, closing a pilot seat orifice, lifting a flow throttling device into a flow throttling orifice and thereby generating a pulse wherein further rotation of said motor drive shaft, and outer magnets move said pilot actuator assembly and said pilot away from said pilot seat causing said flow throttling device to move away from said flow throttling orifice, thereby ending a positive pulse.

19. The method of claim 14, wherein connecting said motor to the drive shaft through a mechanical device including mechanical means including a worm gear, or barrel cam face cam for converting the rotational motion of said motor into linear motion to propel said pilot actuator assembly occurs.

20. The method of claim 14, wherein said apparatus includes a path for said pilot and said flow throttling device to ensure operating of said flow throttling device in a bi-directional axial movement.

21. The method of claim 14, wherein said pilot actuator assembly is comprised of a rear pilot shaft, front pilot shaft, pilot shield, and pilot.

22. The method of claim 14, wherein maximizing differential pressure by utilizing said flow cone is realized in that said cone provides for increasing the velocity of said drilling fluid through said main valve actuator assembly, thereby greatly enhancing the pressure differential and controllability of energy pulses created by engaging or disengaging of said pilot valve from a pilot seat.

23. The method of claim 14, wherein further reducing energy consumption is achieved by pre-filling a bellows chamber with a lubricating fluid, gel or paste.

24. The method of claim 14, wherein said apparatus for generating pulses includes allowing a bellows to move linearly, concurrent with said pilot actuator assembly, wherein designing of said bellows interacting with said pilot actuator assembly and a bellows chamber allows for conforming of said bellows to the space constraints of said bellows chamber, thereby providing flexible sealing without said bellows being displaced by the pressure differential created by said drilling fluid.

25. The method of claim 14, wherein said bellows includes a double loop configuration designed for flexible sealing thereby requiring less energy consumption during displacing said bellows.

26. The method of claim 14, wherein sensing said pulse in drilling mud is achieved by instrumentation located uphole and wherein communicating said pulse requires wireless devices with a computer and associated programmable controller for interpretation of the data associated with said pulse.

27. Two or more apparatuses for generating pressure pulses in a drilling fluid flowing within a coiled tubing assembly comprising:

two or more flow throttling devices longitudinally and axially positioned within the center of a main valve actuator assembly, said main valve actuator assembly comprising a main valve pressure chamber, a magnetic cup encompassing a rotary magnetic coupling containing at least one magnet adjacent to a drive shaft wherein said magnetic cup is located within a pilot actuator assembly, said assembly including a pilot orifice with a pilot valve, a pilot flow shield, a bellows and an anti-rotation block such that passage of said drilling fluid flows through a pilot flow screen and further flows into a main flow entrance into a flow cone through a main orifice and into a main valve past the main valve pressure chamber past a set of seals and through a main valve support block toward a flow seal guide where said fluid combines with a pilot exit fluid that flows toward a main exit flow such that as said fluid becomes a pilot fluid, said pilot fluid subsequently flows through said pilot flow screen into said pilot flow screen chamber through a pilot flow upper annulus, through a pilot flow lower annulus and into a pilot flow inlet channel, wherein said pilot fluid then flows up into a main valve feed channel until it reaches said main valve pressure chamber such that said pilot fluid flows back down the main valve feed channel through a pilot flow exit channel through said pilot orifice and said pilot valve such that said pilot fluid exits said pilot valve and said pilot fluid then flows over said pilot flow shield such that said pilot fluid combines with said main flow to become a main exit flow fluid, said main exit flow fluid then exits a pilot valve support block and flows on either side of said magnetic cup including said rotary magnetic coupling and wherein one or more pressure sensors measuring the pressure of flowing fluid is located inside said pilot valve support block upon which a helical pulser support rests wherein said pilot valve support block also houses an annular pressure sensor residing in an annular pressure inlet and wherein a lower portion of said pilot valve support block also contains a helically cut cylinder that mates with and rests on the helical pulser support that is mounted securely in a tubular hang-off collar such that said annular pressure inlet is aligned with one or more collared annular pressure ports thus still allowing said main exit flow fluid to flow past the drive shaft and motor such that said pilot fluid and main exit flow fluid causes one or more flow throttling devices to generate large, rapid controllable pulses thereby allowing transmission of well-developed signals easily distinguished from any noise resulting from other vibrations due to nearby equipment within said borehole or exterior to said borehole, or within said coiled tubing assembly, wherein said signals also are capable of providing predetermined height, width and shape.

* * * * *